US006870320B2

(12) United States Patent
Ratzinger et al.

(10) Patent No.: US 6,870,320 B2
(45) Date of Patent: Mar. 22, 2005

(54) DEVICE AND METHOD FOR ION BEAM ACCELERATION AND ELECTRON BEAM PULSE FORMATION AND AMPLIFICATION

(75) Inventors: Ulrich Ratzinger, Weiterstadt (DE); Serguej Minaev, Moscow (RU); Stefan Setzer, Weiterstadt-Schneppenhausen (DE)

(73) Assignee: Gesellschaft fuer Schwerionenforschung GmbH, Darmstadt (DE)

( * ) Notice: Subject to any disclaimer, the term of this patent is extended or adjusted under 35 U.S.C. 154(b) by 62 days.

(21) Appl. No.: 10/089,682

(22) PCT Filed: Jul. 20, 2001

(86) PCT No.: PCT/EP01/08413

§ 371 (c)(1),
(2), (4) Date: Jun. 25, 2002

(87) PCT Pub. No.: WO02/15218

PCT Pub. Date: Feb. 21, 2002

(65) Prior Publication Data

US 2002/0180364 A1 Dec. 5, 2002

(30) Foreign Application Priority Data

Aug. 17, 2000 (DE) ..... 100 40 719
Aug. 18, 2000 (DE) ..... 100 40 896

(51) Int. Cl.[7] ..... H05B 31/26
(52) U.S. Cl. ..... 315/111.01; 250/492.21
(58) Field of Search ..... 315/506

(56) References Cited

U.S. PATENT DOCUMENTS 5,767,625 A * 6/1998 Shrader et al. ..... 315/5.37
6,172,463 B1 * 1/2001 Cutler et al. ..... 315/5.42

OTHER PUBLICATIONS

M.B. Shrader, D.H. Priest, R.N. Tornoe, "The 267 MHz High Power CW Klystrode Amplifier", *International Journal of High Speed Electronics and Systems*, vol. 4, No. 4 1993, pp. 349–364.

* cited by examiner

*Primary Examiner*—John R. Lee
*Assistant Examiner*—Phillip Johnston
(74) *Attorney, Agent, or Firm*—Frommer Lawrence & Haug LLP; Ronald R. Santucci

(57) ABSTRACT

The present invention relates to a device for electron beam pulse formation and amplification comprising an electron beam axis (5) for microstructuring and amplifying current pulses. Such a device is especially suitable for pulse frequencies of from 100 to 400 MHz and power amplifications of several megawatts. The device can be used especially for ion beam acceleration, the device being arranged directly in an ion accelerator tank (1) having a central container axis (2) for guiding and accelerating a pulsed ion beam (3) in the container axis (2). The electron beam pulse formation and amplification device (4) is arranged with its electron beam axis (5) transverse and offset relative to the container axis (2) and comprises outside the ion accelerator tank (1) device components for microstructuring the electron beam (14) and, inside the container, comprises device components for output coupling of the electron beam to the consumer, which, in a preferred embodiment, is the ion beam (3) itself. The present invention relates also to corresponding methods of, on the one hand, ion beam acceleration and, on the other hand, electron beam pulse formation and amplification.

40 Claims, 7 Drawing Sheets

DEVICE AND METHOD FOR ION BEAM ACCELERATION AND ELECTRON BEAM PULSE FORMATION AND AMPLIFICATION

The invention relates to a device and to a method for ion beam acceleration and for electron beam pulse formation and amplification according to the independent claims.

Ion beam acceleration of heavy ions, such as carbon ions, oxygen ions and the like in linear accelerators and cyclotron accelerators requires powers in the region of several megawatts at frequencies of about 300 MHz. Conventional high-frequency power amplifiers, such as cavity amplifiers, which can be used generally in a frequency range of from 50 to 200 MHz and in a power spectrum of up to 50 kW, fail for such high powers and at such frequencies. For higher frequencies and higher powers there is the principle of klystron power amplification, which has gained acceptance in the frequency range of from 350 MHz to 20 GHz. As is the case with travelling-wave tubes, klystron power amplification is a linear arrangement, in which a beam emerging from an electron gun is broken down into electron packages by means of longitudinal velocity modulation. In so-called buncher cavities, that microstructure of the beam is produced by means of directional longitudinal high-frequency electrical fields. The electron beam structured in such a manner then produces the desired high-frequency power in the output cavity or output circuit. Once that high-frequency output has been extracted, its residual energy is finally deposited or discharged into a collector. High-power klystrons having operating frequencies of 200 MHz already have an overall length of 5 m. For operating frequencies below that, the overall lengths become unmanageable and the apparatuses unwieldy, and the space that they require is associated with considerable costs. A main reason for the enormous amount of space required resides in the formation of the electron beam pulses or of the electron packages in the tube, necessitating very long drift distances of several hundred centimetres. For substantially lower frequencies, such as below 200 MHz, use is therefore made of cavity amplifiers in the form of output tubes. For the frequency range of from 200 to 350 MHz, however, there are, to date, no economical solutions that permit a high power level of several megawatts and a corresponding operating frequency.

In recent years, a concept known as the klystrode principle has gained acceptance. That principle involves a combination of elements of the tube-operated amplifier and the klystron. The electron pulses are produced by means of a control grid and the pulsed electron beam then passes through an output cavity and a collector in succession. That arrangement can be constructed very compactly, but, insofar as the concept has gained acceptance, it is used for television transmitters having a relatively low transmission power of a maximum of 60 kW in the UHF band, with the result that that solution can be used in competition with standard cavity amplifiers, but cannot yield the high power required for ion beam acceleration.

At frequencies of from 100 MHz to 400 MHz, however, high-power klystrons, which would be perfectly capable of delivering amplification of several megawatts, lose the advantages that they would otherwise have because of the technical outlay and especially because of their overall length at such low frequencies. On the other hand, because of the use of a control grid, klystrodes, as mentioned above, can be used only under extremely limited conditions in terms of the maximum high-frequency output achievable and in terms of the achievable maintenance intervals. Output tubes, such as cavity amplifiers, remain significantly below an output of 1 MW in permanent operation within the frequency range in question, and in pulsed operation the maximum output falls from about 3 MW in the lower frequency range to below 1 MW in the upper frequency range, with the result that these also cannot be used for several megawatts. The overall efficiency in those output tubes also falls as a result of the fact that a cathode heating power of typically 10 kW must be applied continuously at the requisite pulse repetition rates to amplify ion beam pulses of from several Hertz up to 50 Hz.

The problem of the invention is accordingly to provide a high-power high-frequency amplifier in the frequency range of from 100 MHz to approximately 400 MHz that achieves transmission powers of up to 10 MW in pulsed operation with a pulse length of 1 ms and a repetition rate of less than or equal to 50 Hz. A further problem of the invention is to provide a technical solution that overcomes the current critical situation in the manufacture of high-frequency output tubes, whereby fewer and fewer companies are manufacturing such output tubes, with the result that, in addition to the above-mentioned limitations of that type of amplifier, long-term supply does not seem guaranteed.

The problem is solved by the independent claims, and advantageous developments of the invention are to be found in the dependent claims.

According to the invention, a device for electron beam pulse formation and amplification is provided, that comprises an electron gun, a high-frequency deflector, a d.c. voltage deflector, a collector having an opposing field, a post-deflection accelerator, an output coupler to couple the power of the electron beam to a consumer and a main collector for taking up the residual power of the electron beam. For that purpose, the above-listed devices are arranged behind one another in the direction of the electron beam.

The electron beam gun first produces a continuous electron beam, which is deflected in the high-frequency deflector, excited by a high-frequency exciting signal, so that the electron beam can be forwarded periodically in the ion beam axis only in the region of the zero crossings of that signal. That effect is amplified by the subsequent d.c. voltage deflector and the portion of the electron beam that has been deflected is collected in a collector having an opposing field and that current is back-coupled to the cathode of the electron gun. The electron beam that has been broken down into electron packages in that manner is accelerated in a post-deflection accelerator and fed to an output coupler, which is able to couple the power of the electron beam to a consumer. The remaining non-decoupled residual power of the electron beam is fed to a main collector. Thus, instead of the longitudinal velocity modulation used in the klystron, advantageously the present invention uses transverse high-frequency electrical fields in the high-frequency deflector and transversely-directed static electrical fields in the d.c. voltage deflector, in order to form and pre-amplify electron pulses.

Accordingly, within a high-frequency period about 80% of the continuously delivered electron beam is deflected and collected in a negatively biased collector having opposing voltage. The remaining electron beam pulses continuing on the beam axis in the form of electron packages then pass through the main acceleration of several hundred kilovolts and, so accelerated, reach the output cavity of the output coupler, which couples the power of the electron beam to a consumer. The non-decoupled residual power is collected in the main collector. In this design, in a frequency range of from 100 to 400 MHz, the electron beam pulse formation itself can be housed within an overall length of only 0.5 m. That constitutes an improvement by reducing the overall length by more than tenfold, especially in view of the fact that a klystron for 350 MHz at the required power consumption is already 5 m in length. This obviates a substantial reason against the use of the klystron for low frequencies. In the solution according to the invention, the efficiency of the klystron for the production of high-frequency powers is achieved at substantially shorter overall length.

In a preferred embodiment of the invention, the consumer is an antenna of a coaxial cable end, which projects into a resonator that is coupled to the electron beam by way of an annular gap surrounding the electron beam. That embodiment extracts a substantial amount of the resonance energy from the resonator by means of its antenna, and the electrons in the electron beam are thus decelerated so that only a small amount of remaining non-decoupled residual power has to be collected in the main collector.

In a further preferred embodiment of the invention, the consumer is an antenna coupler of a waveguide which is passed through the wall of the resonator chamber in the form of a coaxial duct. For that purpose, the antenna coupler projects into the resonator chamber, which surrounds the electron beam by means of an annular gap, with the result that energy from the electron beam can be coupled into the resonator and is then drawn off further to the waveguide by way of the antenna coupler duct.

In a further preferred embodiment of the invention, the consumer is a coupling window to a waveguide, in which the coupling window opens to the resonator. In that embodiment also, the electron beam is surrounded by the resonator by means of an annular gap.

A further solution according to the invention consists of a device for ion beam acceleration that comprises an ion accelerator tank having a central container axis for guiding and accelerating a pulsed ion beam of heavy ions in the container axis. That device further comprises an electron beam pulse formation and amplification device having an electron beam axis for microstructuring and amplifiers of current pulses to supply the device for ion beam acceleration with high-frequency power.

That solution is characterised in that the electron beam pulse formation and amplification device is arranged with its electron beam axis transverse and offset relative to the container axis and comprises, outside the ion accelerator tank, an electron gun, a high-frequency deflector, a d.c. voltage deflector, a collector having an opposing field and a post-deflection accelerator, whereas inside the ion accelerator tank the device comprises an output coupler to provide coupling of the power of the electron beam to a consumer and a main collector for taking up the residual power of the electron beam. The components of the electron beam pulse formation and amplification device listed are arranged behind one another in the direction of the electron beam.

That solution has the advantage that the ion accelerator tank itself is used simultaneously as an output circuit for the power amplification step. A transfer of power from the amplifier to the tank is not required. Coupling of the output stage to the tank volume is thus possible. An assembly for ion beam acceleration for ion beams for heavy ions is thus obtained, which can be manufactured extremely manageably and extremely inexpensively.

To provide coupling between an operative electron beam and an ion accelerator tank, there is used a site, of suitable potential, along the drift tube mounting of the ion beam. A transverse electrical alternating field with suitable time structure deflects electrons in an unfavourable temporal position directly after the pre-acceleration of the electron beam, with the result that only electron pulses having the desired frequency for amplifying the ion beam pulses pass through the main acceleration and are then decelerated in the field of the ion accelerator tank, because their energy is coupled to the ion beam.

Thus, in a preferred embodiment of the invention, the consumer is directly the pulsed ion beam.

In a further preferred embodiment of the invention, the output coupler comprises a resonator having in the ion accelerator tank an upper annular gap surrounding the electron beam radially and a lower annular gap surrounding the electron beam radially. Passage of the electron beam through two annular gaps, namely an upper and a lower annular gap, in the tank appears to be advantageous since the electron beam has to reach the cooled collector in order to discharge its residual energy in the main collector. For that purpose, advantageously the drift distance between the gaps is kept as short as possible in order to achieve favourable geometry that does not substantially impair the voltage distribution across the foot of the drift tube. In addition, independently of their phase position in the pulse, as the electrons pass through the two annular gaps they advantageously discharge the same energy to the ion beam, with the result that the residual energy in the main collector or collector is less than 10% of the pulse energy.

In order to arrange annular gaps that have been adapted in such a manner in the ion accelerator tank, the output coupler also comprises between the annular gaps a coupling stage, which surrounds the electron beam coaxially and is arranged radially offset and transverse to the ion beam inside the ion accelerator tank, the coupling stage being fastened to a drift tube mounting of the ion beam.

In a further preferred embodiment of the invention, the electron beam gun is a Pierce-type electron beam gun. Such a gun advantageously produces a high-perveance electron beam having correspondingly high space-charge constants according to the Child-Langmuir equation at pulse lengths of 1 ms, which achieves a gun current of, for example, 40 A at an acceleration voltage of 40 kV.

In a further preferred embodiment, the high-frequency deflector comprises a homogeneous transversely directed alternating field, by means of which short electron beam packages are created in the operating frequency range of from 100 to 400 MHz, whereas the electron beam in the interpulse periods is deflected and fed to a collector having an opposing field, which in turn makes the current available to the cathode of the electron beam gun.

In a further preferred embodiment of the invention, the d.c. voltage deflector comprises a non-homogeneous temporally constant transverse electrical field, whereas the electron beam is simultaneously transversely stabilised by means of a longitudinal magnetic field, with the result that the condition of Brillouin equilibrium remains fulfilled.

In a further preferred embodiment, the output coupler comprises in its output circuit a resonator, which communicates with the electron beam by way of an annular gap. Energy can in turn be extracted from the resonator by a consumer, which is coupled thereto by a coaxial lead or a waveguide or is coupled directly thereto, as in the case of the ion beam, with the result that the electron packages in the electron beam are decelerated and have to be collected in the main collector with only very low energy which, in some cases, is below 10% of the total electron beam energy.

In addition to the solution found for direct coupling to an ion beam consumer, the output circuit also comprises a single-column annular cavity as resonator, with the cavity surrounding the ion beam. By means of that solution it is possible to connect any desired consumers to the power-amplifying device according to the invention by way of coaxial cables or waveguides.

The pulse length and the repetition rate of the electron beam, the so-called macrostructure, can be freely selected in the solution according to the invention, with the result that it is possible to achieve pulse lengths of one millisecond at repetition frequencies of below 50 Hz and an output of 10 MW with the device according to the invention and the method according to the invention.

Since a narrow-band HF resonator, as indicated in the preferred embodiments of the invention in the form of an annular cavity having an annular gap, can be excited effectively by an electron beam only when the beam has an intensity modulation at the corresponding operating frequency, that so-called microstructure of the electron beam is produced by means of the method according to the invention. That method according to the invention for electron beam pulse formation and amplification comprises the following method steps:

production of an electron beam by means of an electron beam gun;

action upon the electron beam of a high-frequency alternating field with simultaneous high-frequency deflection of the electron beam;

high-frequency extraction of up to 80% of the electron beam energy to a collector having an opposing field;

post-deflection acceleration of the high-frequency-modulated electron beam to give amplified electron beam pulses;

decoupling of the high-frequency energy by way of an output coupler.

Thus, the beam passes first of all through a homogeneous transversely directed electrical alternating field, and then through a non-homogeneous temporally constant transverse electrical field. In the process, about 80% of the electron beam is deflected from the beam axis and, at a virtually constant electron energy of 40 keV, is collected in a biased collector at, for example, U=−40 kV+x. The energy of those electrons can then largely be returned to the cathode of the electron gun and serves as charging current.

The undeflected portion of the beam, which is present in the form of particles or electron packages temporally spaced in accordance with the operating frequency, moves further along the beam axis and passes through the main acceleration voltage, which may be, for example, at 300 kV, and then enters the output circuit of the resonator. Such a resonator can comprise a single-column annular cavity, as is customary in other solutions. Such a resonator is excited by the electron packages passing through, and the high-frequency fields arising in the resonator decelerate the electrons and simultaneously feed the output of the amplifier, which can preferably be a coaxial lead or a waveguide having corresponding coupling antennae or a corresponding coupling window. Finally, the residual electron energy is deposited in the main collector, the formation of the electron beam microstructure according to the invention in particular ensuring a reduction in the overall length of klystron power amplifiers that are otherwise customary for higher operating frequencies.

Thus, in a preferred embodiment of the method, the high-frequency energy is decoupled by way of a coaxial cable that projects, by way of an antenna, into an annular resonator chamber that communicates with the high-frequency energy-rich electron beam by way of an annular gap surrounding the electron beam.

In a further preferred embodiment of the method, the decoupling of the high-frequency energy is achieved by way of a waveguide which projects, by way of a coupling antenna, into an annular resonator chamber that communicates with the high-frequency energy-rich electron beam by way of an annular gap surrounding the electron beam.

In a further preferred embodiment of the method, the decoupling of the high-frequency energy will be effected by way of a waveguide connected to an annular resonator chamber by way of a coupling window, the annular resonator communicating with the electron beam by way of an annular gap surrounding the electron beam.

In a further preferred embodiment of the method, an electron beam having high perveance according to the Child-Langmuir equation is produced by an electron beam gun having a gun current of from 20 A to 60 A, preferably from 30 to 50 A, at an acceleration voltage ($U_c$) of from 20 kV to 60 kV, preferably from 30 kV to 50 kV.

In a further preferred embodiment of the method, the electron beam is stabilised transversely in Brillouin equilibrium by means of a longitudinal magnetic field. Furthermore, the intensity-modulated electron beam excites a narrow-band high-frequency resonator in the output circuit at an operating frequency. For that purpose, the electron beam passes through a homogeneous transversely directed electrical alternating field, with from 50 to 80% of the electron beam energy being deflected from the beam axis.

In a further preferred embodiment of the method, at a virtually constant electron energy of from 30 keV to 60 keV, the deflected portion of the electron beam is collected in a biased collector having an opposing field of from −30 kV to −40 kV. In the process, the energy of the collected electrons is collected in the collector having an opposing field and is fed as a charging current to the cathode of the electron gun.

In a further preferred embodiment of the method, the undeflected electron packages are moved and guided along the beam axis at the temporal spacing of an operating frequency and enter an output circuit of the device, which output circuit is in the form of a resonator, at a main acceleration voltage of from 200 kV to 400 kV. In the process, the resonator in the output circuit of the device starts to operate, with high-frequency fields in the resonator taking up the energy of the electrons, decelerating them and feeding an output, preferably a coaxial cable and/or a waveguide.

The remaining residual energy of the electrons is preferably deposited in a main collector. In a preferred embodiment of the method, for electrical beam deflection in the high-frequency deflector for an operating frequency f the actuating high-frequency signal is composed of a main component at a frequency of f/2 and a superposition of a frequency of 5f/2 in an amplitude ratio of 5:1. The operating frequency is from 100 to 400 MHz and, per period, about 20% of the electron beam particles are passed on in pulses, since, as a result of the superposition of the two frequencies, a corresponding zero crossing is obtained for a corresponding timespan per period.

The invention will now be explained in greater detail with reference to Figures, in which.

Figure 4A:
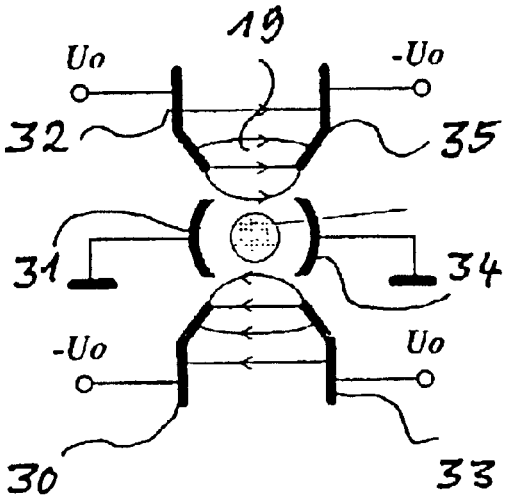
Figure 4B:
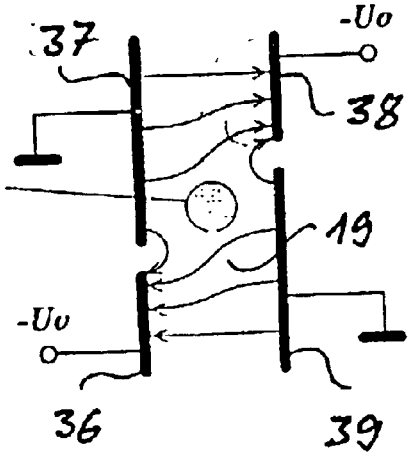

FIGS. 4*a* and 4*b* are schematic diagrams of possible electrical fields in a d.c. voltage deflector.

Figure 5:
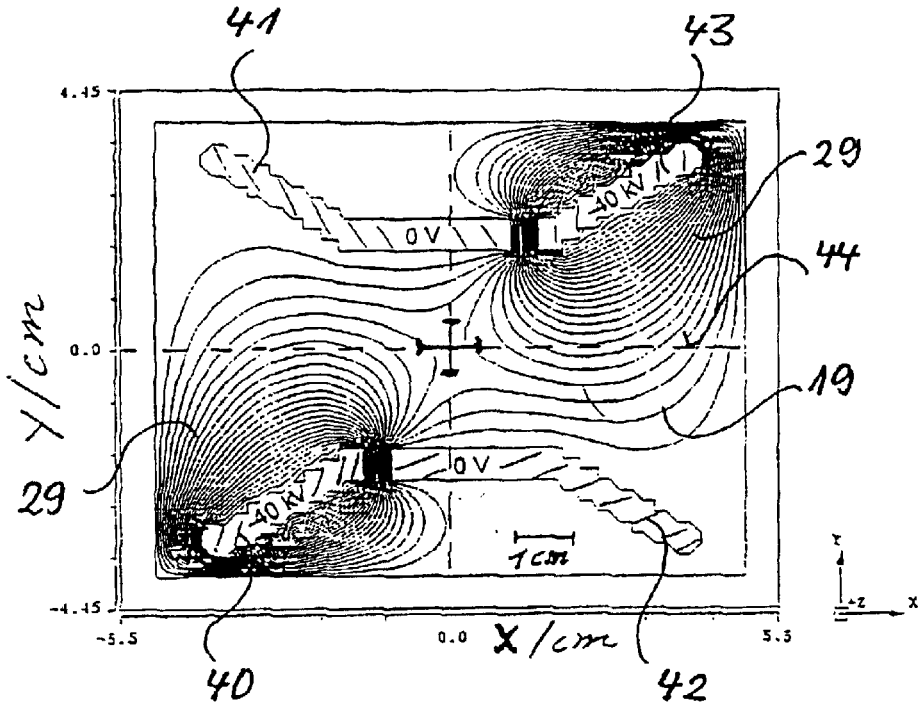

FIG. 5 is a cross-section through an asymmetrical d.c. voltage deflector having the equipotential lines drawn in.

Figure 6:
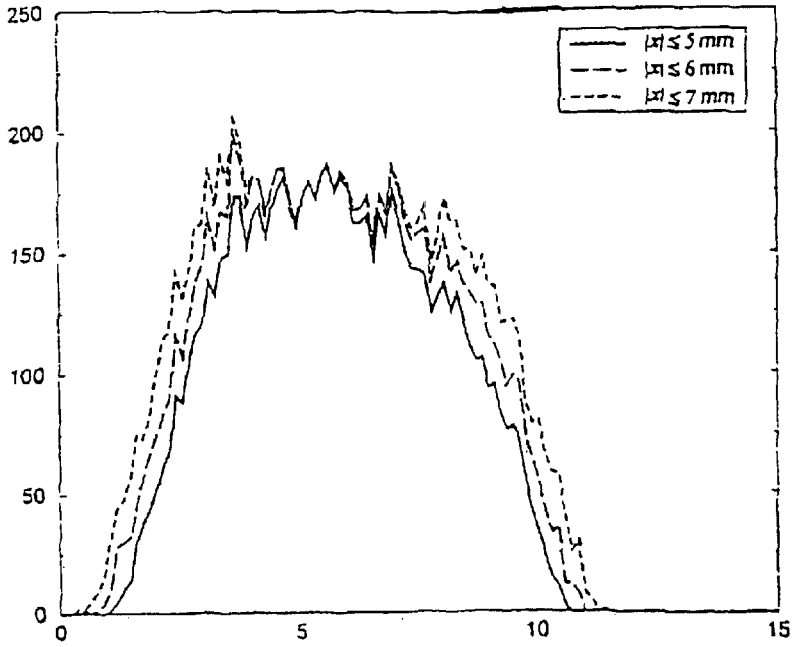

FIG. 6 shows a plurality of intensity profiles along the electron beam axis for various diaphragm openings of the collector having an opposing field.

Figure 7:
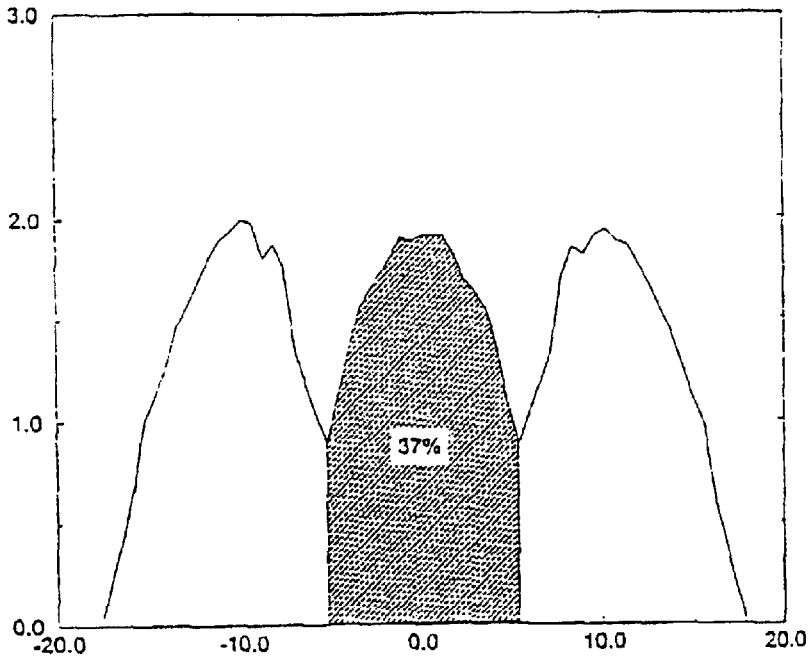

FIG. 7 is a diagram of the distribution density of the electrons after passing through the high-frequency deflector.

Figure 8:
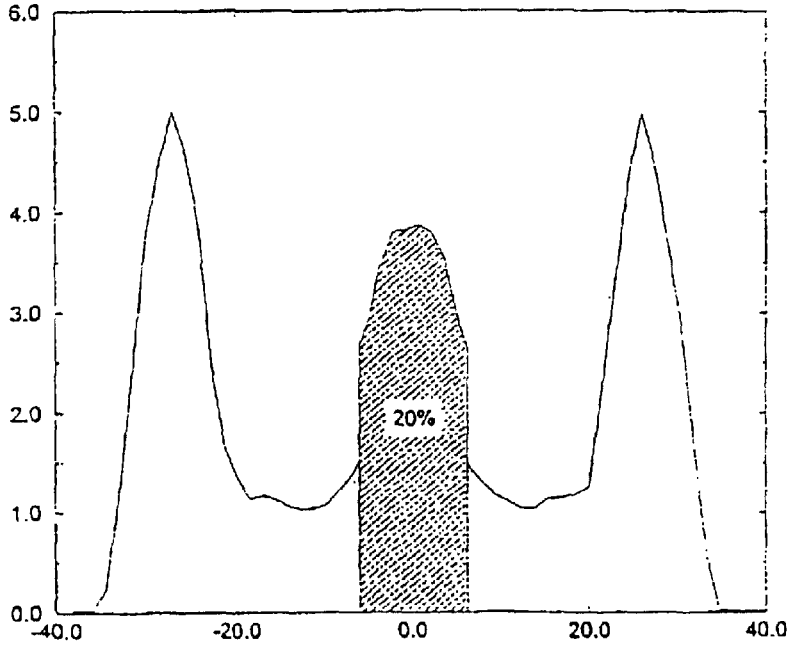

FIG. 8 is a diagram of the distribution density of the electrons after passing through the high-frequency deflector and the d.c. voltage deflector.

Figure 9:
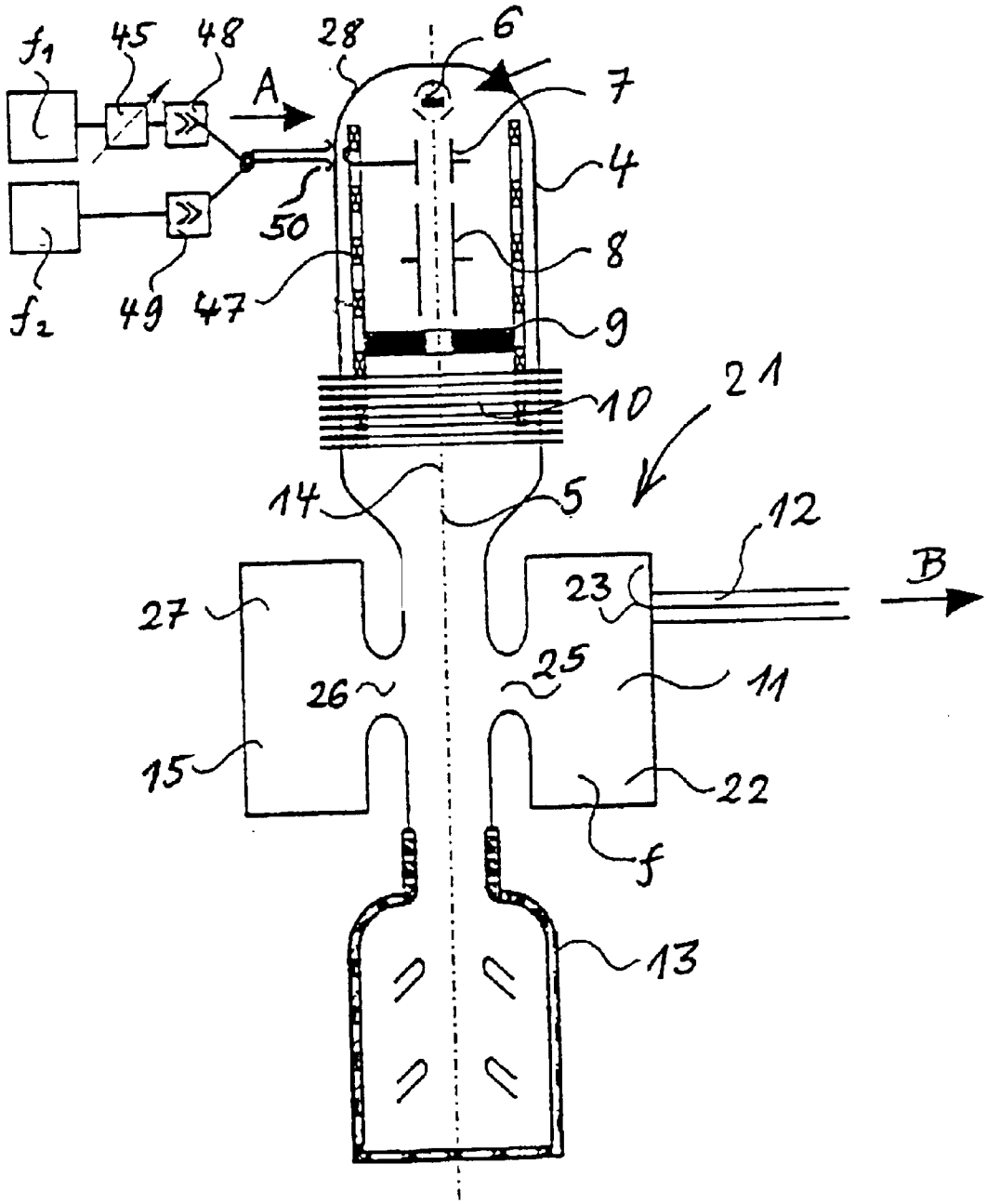

FIG. 9 is a schematic diagram of a device for electron beam pulse formation and amplification.

Figure 10:
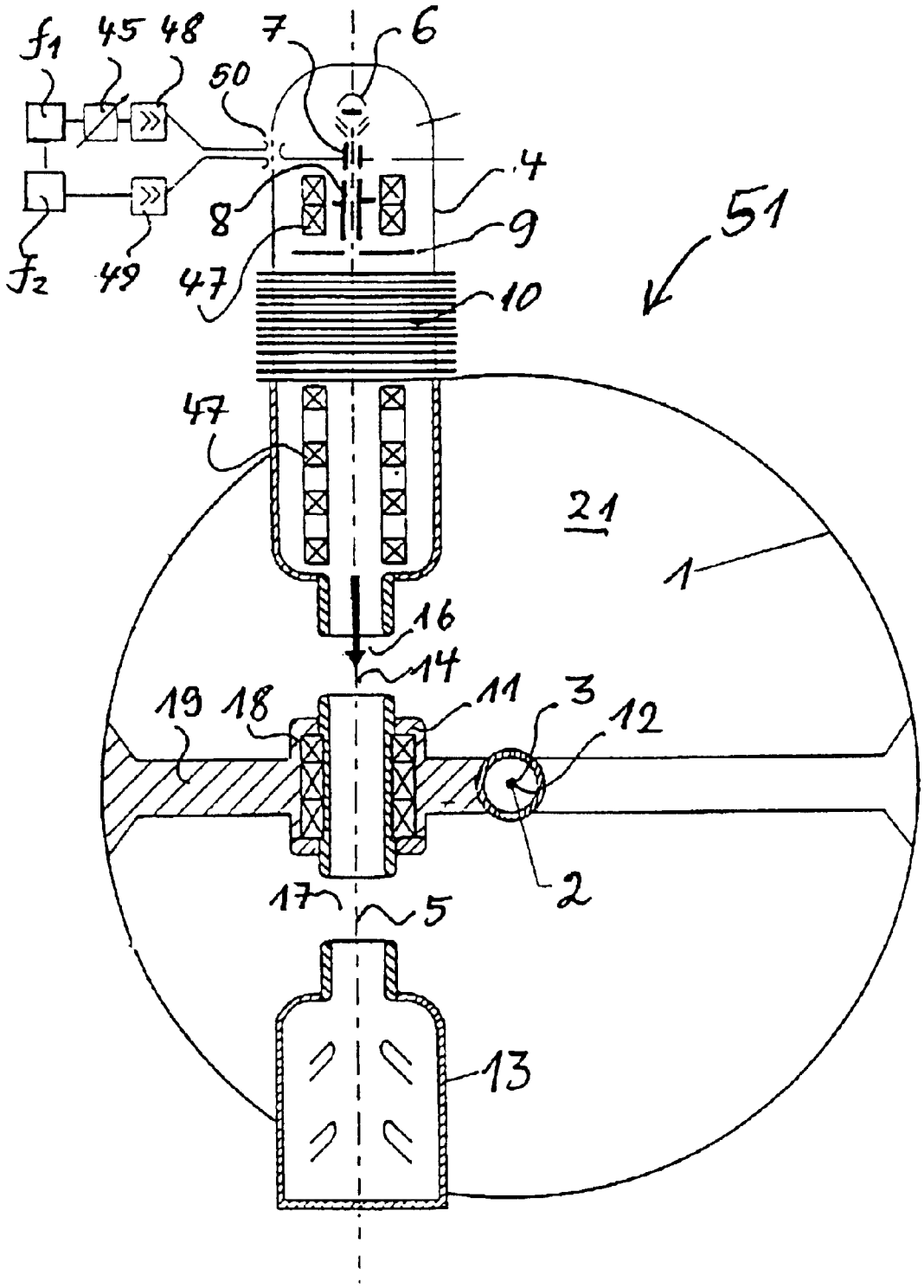

FIG. 10 is a schematic diagram of a device for ion beam acceleration.

Figure 1:
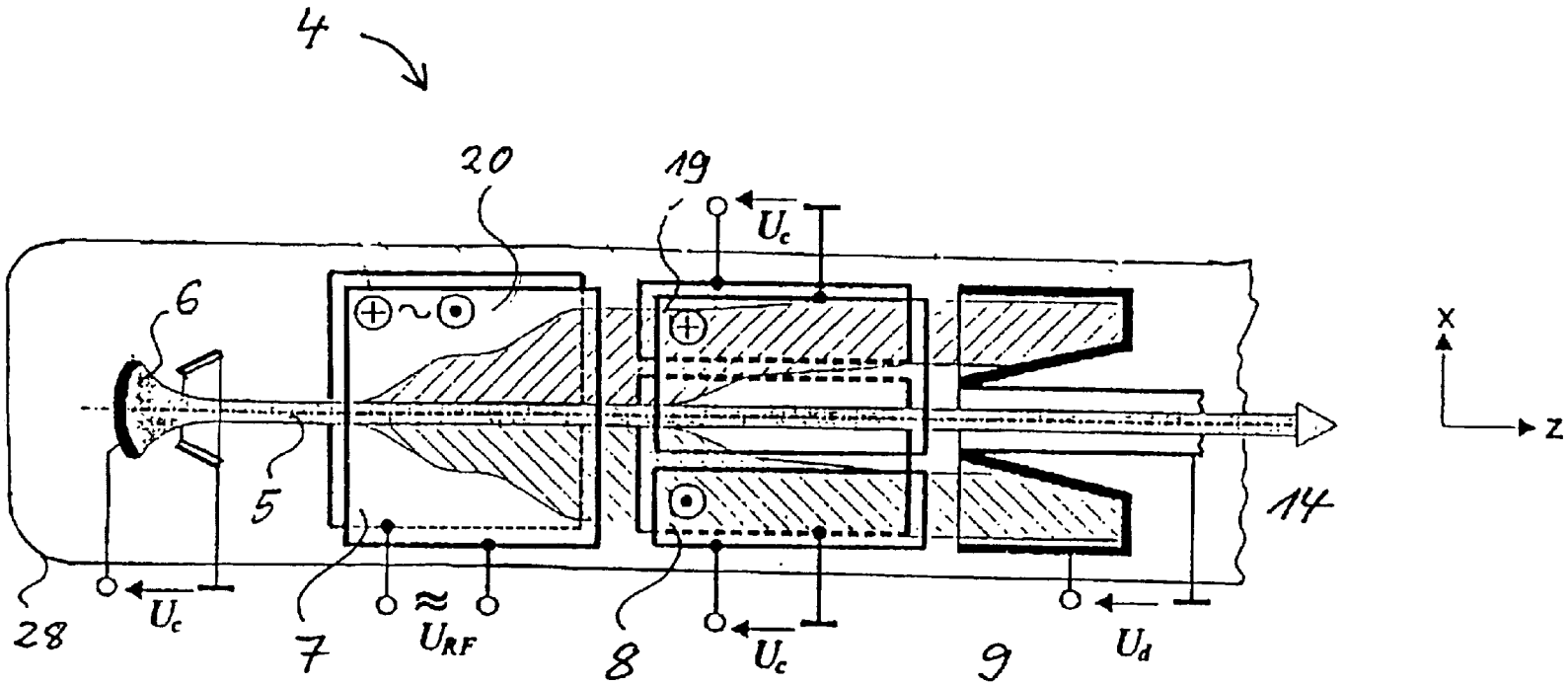
FIG. 1 is a schematic diagram of a first embodiment of a device for electron beam pulse formation and amplification.

FIG. 1 is a schematic diagram of a first embodiment of a device for electron beam pulse formation and amplification. The device consists substantially of a vacuum-tight housing 28, in which there are housed, connected in series, an electron gun 6, a high-frequency deflector 7, a d.c. voltage deflector 8, a collector having an opposing field 9 and a post-deflection accelerator (not shown), which is indicated in FIG. 9 by the reference number 10. The schematic diagram in FIG. 1 serves essentially to illustrate the principle by which the transverse deflection unit for microstructuring the electron beam functions. The corresponding multiparticle calculations for the formation of electron packages in that device were carried out using suitable software packages.

The section shown in FIG. 1 from the electron gun 6 to the collector having an opposing field 9, which collects the deflected electrons that are shown in the beam cross-section shown in the x/z plane by hatching, comprises the main parts of the electron beam formation device according to the invention. There can clearly be seen the two deflection systems 7 and 8 arranged directly behind one another, it being possible for the second electrostatic deflection unit 8 to be supplied by the cathode potential $U_c$. The electrical field direction $E_y$, which is arranged perpendicular to the plane of representation, must be oriented, for x>0, in the opposite direction than for x<0 in order to amplify further the electron deflection of the high-frequency deflection unit connected in series before it. The surrounding area of the z axis, as shown in the diagram, is kept virtually field-free in the d.c. voltage deflector 8 by overlapping of the earthed electrodes, in order to disrupt the electron packages that are passing through as little as possible.

Figure 2:
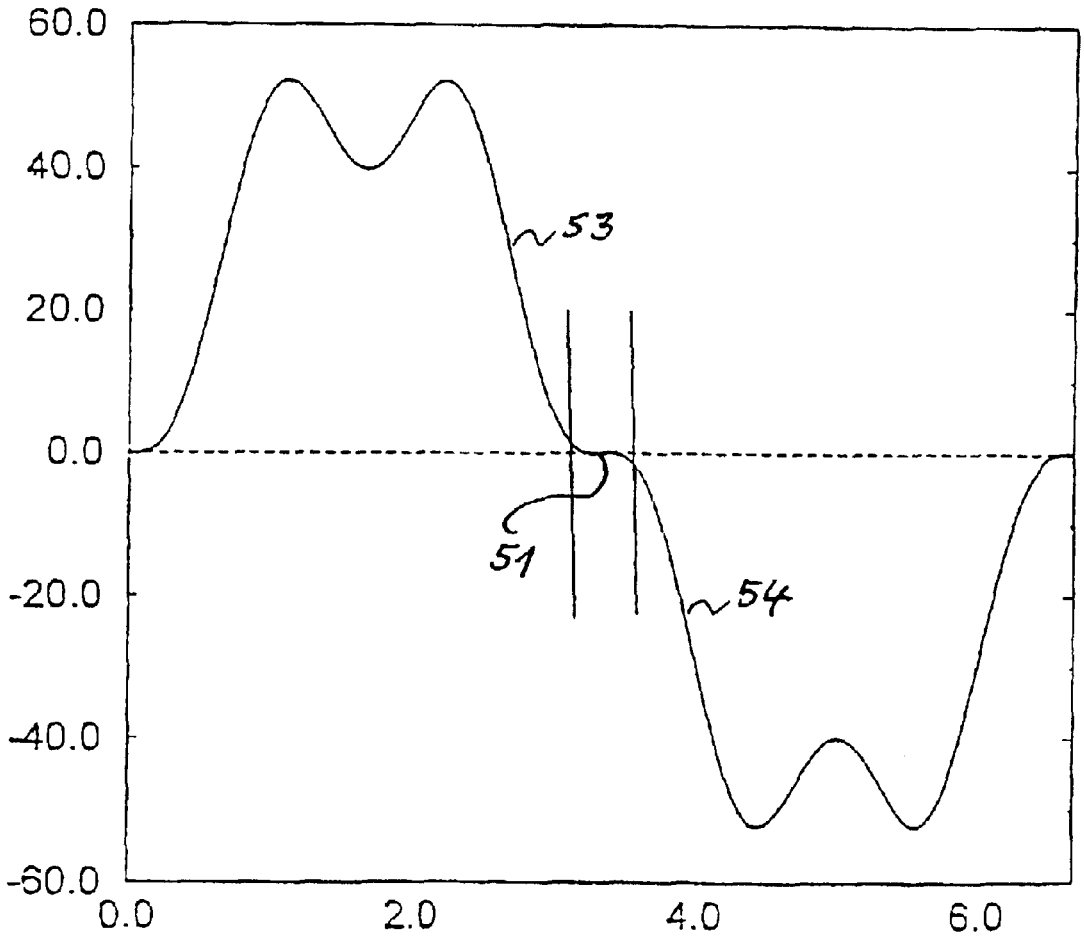
FIG. 2 is a diagram of a period of a high-frequency voltage signal applied to a high-frequency deflector.

FIG. 2 is a diagram of a period of a high-frequency voltage signal applied to the high-frequency deflector 7. Time is plotted in nanosecond units on the abscissa and the high-frequency deflection voltage is plotted in kV on the ordinate. Within a high-frequency period at an operating frequency f, corresponding excitation frequencies of the high-frequency deflector 7 produce a recurring plateau 51 at voltage 0 V. That recurring plateau 51 at voltage 0 V defines the proportion of beam passing through that is not deflected. The diagram of FIG. 2 also indicates the steeply graded voltage slopes 53 and 54 at the start and end of the plateau 51, as a result of which strong deflection of the electron beam is triggered, which, in turn, defines the interpulse periods. The plateau itself corresponds approximately to a proportion of the beam of 20% or to a phase width of 70° in units of the operating frequency. Accordingly the actuating HF signal consists of a main component at frequency f/2 and a superposed frequency 5f/2. At an amplitude ratio of about 5:1 and the corresponding phase relation, the desired signal form shown in FIG. 2 is produced, which is composed of components $V=\sin(\pi ft)-0.2\ V\times\sin(5\pi ft)$.

Figure 3:
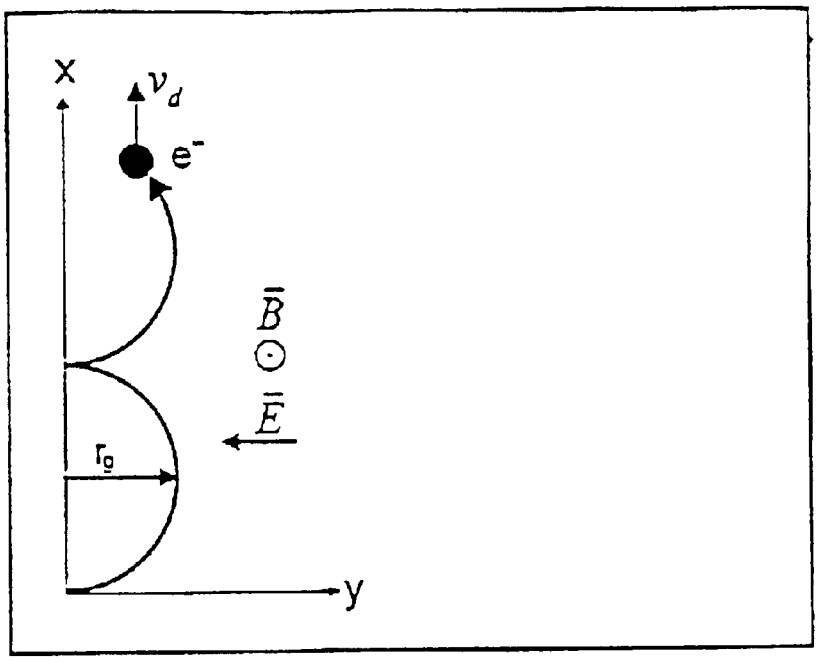
FIG. 3 shows the deflection action on electrons in a high-frequency deflector.

FIG. 3 shows the deflection action on the electrons in a high-frequency deflector 7. The electrons describe the paths shown there in the x/y plane under the influence of the electrical and magnetic fields. The advantage of crossed electrical and magnetic fields is that the deflection by means of E×B drift occurs substantially in the x/y plane such that the deflector plates of the high-frequency deflector 7 constitute no delimitation, provided the gyroradius $r_g$ is suitably selected.

FIGS. 4*a* and 4*b* are schematic diagrams of possible electrical fields in a d.c. voltage deflector 8. In the embodiment under discussion here, the asymmetrical d.c. voltage deflector of FIG. 4*b* is used in a slightly modified form, as shown in FIG. 5. Compared with the symmetrical d.c. voltage deflector of FIG. 4*a*, the asymmetrical d.c. voltage deflector 8 has the advantage of being simpler to construct as a result of having only four deflection plates 36 to 38 compared with six deflection plates 30 to 35 in FIG. 4*a*.

FIG. 5 is a cross-section through an asymmetrical d.c. voltage deflector 8 having the equipotential lines 29 drawn in. It can be seen clearly in this diagram that the centre between the deflection plates 40 to 43 is kept field-free so that electrons that fly through those deflection plates in the centre are not additionally deflected or are deflected additionally only to a small degree. Moreover, the modification of the embodiment according to FIG. 5, compared with the schematic diagram according to FIG. 4*b*, lies in the fact that the earthed (0 V) deflection plates 41 and 42 are initially parallel to the centre line 44 and then a part thereof is at an angle thereto, and the deflection plates acted upon by a negative voltage of −40 kV in that embodiment are completely angled relative to the centre line 44.

FIG. 6 shows a plurality of intensity profiles along the electron beam axis in the z direction for a variety of diaphragm openings of a collector 9 having an opposing field. In that diagram, the z direction is plotted in centimetres along the abscissa and the electron beam density is plotted in any desired units along the ordinate by way of comparison. The curves were plotted for three different diaphragm openings of the collector 9 having an opposing field of ≦5 mm, ≦6 mm and ≦7 mm. The pulse package or electron package that is emitted periodically through that diaphragm is not quite 10 cm in length, the length increasing slightly with increasing diameter of the opening in the collector 9 having an opposing field. The intensity maximum at that pulse width does not, however, depend upon the diaphragm opening; rather the intensity maximum is clearly determined by the d.c. voltage deflector with an acceleration voltage $U_c$ and is also equally intensive at uniform d.c. voltage.

FIG. 7 is a diagram of the distribution of the electron density after passage through the high-frequency deflector. In that diagram, the x position is plotted in mm on the abscissa and the electron density is plotted in any desired units on the ordinate. After passage through the high-frequency deflector 7, approximately 37% of the electrons still lie in the central passband of the electron beam formation device, whereas large amounts of the electron beam are deflected below or above by the high-frequency alternating field and are not available for further acceleration. The d.c. current electron beam, as it emerges from the electron gun 6, is accordingly already divided into electron packages. This is shown even more clearly in FIG. 8.

FIG. 8 is a diagram of the distribution of electron density after passage through the high-frequency deflector 7 and the d.c. voltage deflector 8. Again, the x position is plotted in mm on the abscissa and the electron density is plotted in any desired comparable units on the ordinate. After the d.c.

voltage deflector, the maxima of the deflected electrons concentrate at a distinct spacing from the centre of the beam, which lies at 0.0 mm. Only 20% of the electrons remain in the centre of the beam and can be further accelerated in the subsequent high-accelerator. That 20% is formed of electron packages or electron pulses as shown spatially in FIG. 6. The cross-section of the particle packages to be transported further in its density distribution is about 13 mm in the x direction and about 11 mm in the y direction. The diaphragm opening of the collector having an opposing field cuts a corresponding electron pulse beam from that cross-section.

FIG. 9 is a schematic diagram of a device for electron beam pulse formation and amplification. In FIG. 9, identical reference numbers identify identical components of the device as in FIG. 1. For that reason, an explanation of those device components will largely be omitted. In FIG. 9, in addition to the device components shown in FIG. 1, there can be seen a frequency converter $f_1$ which oscillates at half the operating frequency f and is fed, via a phase shifter 45, to an amplifier 48 which amplifies the signal of the frequency converter $f_1$ to about 50 kW. Superposed on that signal is a signal that is delivered by a second frequency converter $f_2$, which produces a frequency of 5f/2 and superposes that signal upon the signal of the first frequency converter at the coupling point 50. In the process, in addition to the correct phase, amplitude adaptation is carried out by the amplifier 49, so that the amplitude of the signal of the frequency converter $f_2$ is only ⅕ of the amplitude of the frequency converter $f_1$. That signal, which takes the shape of the diagram shown in FIG. 2 for a period of time, is applied to the plates of the high-frequency deflector 7. Superposed on the signal is a magnetic field, which is produced by the coil 47 inside the housing 28.

An electron beam 14 is produced between the plates in the electron beam axis 5 by an electron beam gun 6, which, in that embodiment, is a Pierce-type electron beam gun. That electron gun produces a high-perveance electron beam having high space-charge constants according to the Child-Langmuir equation and is stabilised transversely by means of a longitudinal magnetic field of the coil 47 and held in Brillouin equilibrium.

After the electron beam has been divided up in the high-frequency deflector 7, both the deflected electron packages and the electron packages remaining in the centre of the axis are guided through the d.c. voltage deflector 8. In the process, the temporal spacing of the packages is determined by the operating frequency f, which is from 100 to 400 MHz. Whilst the portion of the electron beam package that is deflected is taken up by the collector 9 having an opposing field and is fed by way of a connecting lead to the cathode of the electron beam gun 6, the approximately 20% of the electrons of the electron beam that are in the centre reach the post-deflection accelerator 10, which amplifies the energy of the electron beam pulses or electron packages at an acceleration voltage, in this embodiment, of 300 kV, enabling them to interact with the connecting annular resonator 15 by way of the annular gap 25.

The resonator, which is excited by the frequency of the electron beam, extracts energy from the electron packages, which energy is fed, in this embodiment, to a coaxial output 12 by way of an antenna 23. That coaxial cable can be connected to a consumer. In other embodiments of the invention, the consumer is directly an ion beam of an acceleration chamber or of an ion accelerator tank, for example of an ion beam therapy system or an ion beam system for investigating materials, which is operated substantially with heavy ions, such as carbon and oxygen ions.

The output 12 may also be a waveguide, which communicates with the resonator 15 by way of a coupling window or is connected to the resonator 15 by way of a coaxial duct. The energy not extracted from the resonator 15 and thus from the electron beam 14 through the output is taken up by the main collector 13. That main collector 13 preferably has water-cooled walls in order to draw off the residual energy which, in this embodiment, is below 10%. At a maximum output of 10 MW, however, a high cooling capacity is required in order to prevent the housing of the main collector from melting.

FIG. 10 is a schematic diagram of a device for ion beam acceleration. The principle according to the invention has the advantage that it can be introduced directly into a system for ion beam acceleration. Accordingly, FIG. 10 shows a device 51 for ion beam acceleration that comprises an ion accelerator tank 1 having a central container axis 2 for guiding and accelerating a pulsed ion beam 3 in the container axis 2. For that purpose, an electron beam pulse formation and amplification device 4 having an electron beam axis 5 for microstructuring and amplifying current pulses to supply the device 51 for ion beam acceleration with high-frequency power is arranged in such a manner that the electron beam pulse formation and amplification device 4 is arranged with its electron beam axis 5 transverse and offset relative to the container axis 2, and comprises, outside the ion accelerator tank 1, an electron beam gun 6, a high-frequency deflector 7, a d.c. voltage deflector 8, a collector 9 having an opposing field and a post-deflection accelerator 10 and comprises, inside the ion accelerator tank 1, an output coupler 11 for coupling the power of the electron beam 14 to a consumer 12, which, in this case, is the pulsed ion beam 3, with a main collector 13 taking up the residual power of the electron beam 14 and the mentioned components of the device being arranged behind one another in the direction of the ion beam 14.

In order to decouple the energy of the electron beam 14 from the electron beam pulse formation and amplification device 4, there are arranged an upper annular gap 16 and a lower annular gap 17 having arranged between them a coupling stage that surrounds the ion beam coaxially. The coupling stage 18 is held by the drift tube mounting 19, which simultaneously surrounds the ion beam 3 in the region of the centre of the ion accelerator tank 1. The size of the gap and the spacing of the gap and the displacement spacing between the electron beam axis and the ion beam axis are matched to one another in such a manner that the volume of the ion accelerator tank 1 can serve as a resonator for the pulsed electron beam, the resonator acting directly upon the pulsed ion beam guided in the centre.

Half the operating frequency f of the ion beam 3 is fed to a coupling point 50 in the frequency converter $f_1$ by way of a phase shifter 45 and an amplifier 48, at which coupling point 50 there is simultaneously applied, by the frequency converter $f_2$, by way of the amplifier 49, the f5/2 operating frequency f. Those superposed frequencies are used to operate the high-frequency deflector 7, which modulates the ion beam from the electron beam gun 6.

Then, in a d.c. voltage deflector 8 the deflection and separation between deflected ion beam portions and thus the interpulse intervals, and ion beam portions that are guided further in the centre and thus pulse lengths, are amplified, with the result that the deflected ion beam portions can be taken up by the collector 9 having an opposing field. The electron packages guided further centrally on the ion beam axis 5 are brought to a correspondingly high energy in the post-deflection accelerator 10 so that they can enter into resonance with the volume space of the ion accelerator tank 1. In the process, a substantial portion of the electron beam energy is transferred to the ion beam pulses, whilst a small residual amount of less than 10% of the electron beam energy is fed to the main collector 13. In contrast to FIG. 9, this solution according to the invention comprises an upper annular gap 16 and a lower annular gap 17, which surround the electron beam, whilst a coupling piece 18 is arranged between them.

List of reference numbers

| | |
|---|---|
| 1 | ion accelerator tank |
| 2 | central container |
| 3 | pulsed ion beam |
| 4 | electron beam pulse formation and amplification device |
| 5 | electron beam axis |
| 6 | electron gun |
| 7 | high-frequency deflector |
| 8 | d.c. voltage deflector |
| 9 | collector having an opposing field |
| 10 | post-deflection accelerator |
| 11 | output coupler |
| 12 | consumer |
| 13 | main collector |
| 14 | electron beam |
| 15 | resonator |
| 16 | upper annular gap |
| 17 | lower annular gap |
| 18 | coupling stage |
| 19 | non-homogeneous field |
| 20 | homogeneous transversely directed alternating field |
| 21 | output circuit |
| 22 | annular cavity |
| 23 | antenna |
| 24 | coaxial cable |
| 25 | annular gap |
| 26 | single-column cavity |
| 27 | annular resonator chamber |
| 28 | housing |
| 29 | equipotential lines |
| 30–35 | deflection plates of the symmetrical d.c. voltage deflector |
| 36–39 | deflection plates of the asymmetrical d.c. voltage deflector |
| 40–43 | deflection plates of the d.c. voltage deflector |
| 44 | centre line |
| 45 | phase shifter |
| 47 | coil |
| 48 | amplifier |
| 49 | amplifier |
| $f_1$ | frequency converter |
| $f_2$ | frequency converter |
| 50 | coupling point |
| 51 | device for ion beam acceleration |
| 52 | plateau |
| 53–54 | slopes |

What is claimed is:

1. Device for ion beam acceleration, comprising:

(A) an ion accelerator tank (1) having a central container axis (2) for guiding and accelerating a pulsed ion beam (3) in the container axis (2), (B) an electron beam pulse formation and amplification device (4) having an electron beam axis (5) for microstructuring and amplifying current pulses to supply the device for ion beam acceleration with high-frequency power, characterised in that the electron beam pulse formation and amplification device (4) is arranged with its electron beam axis (5) transverse and offset relative to the container axis (2) and comprises outside the ion accelerator tank (1)

(a) an electron gun (6), (b) a high-frequency deflector (7), (c) a d.c. voltage deflector (8), (d) a collector (9) having an opposing field, and (e) a post-deflection accelerator (10)

and comprises inside the ion accelerator tank (f) an output coupler (11) for coupling the power of the electron beam (14) to a consumer (12), (g) a main collector (13) for taking up the residual power of the electron beam (14), components (a) to (g) of the device being arranged behind one another in the direction of the electron beam (14).

2. Device according to claim 1, characterised in that the consumer (12) is the pulsed ion beam (3).

3. Device according to claim 1, characterised in that the output coupler (11) comprises a resonator (15) having in the ion accelerator tank (1) an upper annular gap (16) surrounding the electron beam (14) radially and a lower annular gap (17) surrounding the electron beam (14) radially.

4. Device according to claim 1, characterised in that the output coupler (11) comprises a coupling stage (18) arranged between annular gaps (16, 17), which coupling stage surrounds the electron beam (14) coaxially and is arranged radially offset and transverse to the ion beam (3) inside the ion accelerator tank (1), the coupling stage (18) being fastened to a drift tube mounting (19) of the ion beam (14).

5. Device according to claim 1, characterised in that the electron beam gun (6) is a Pierce-type electron beam gun.

6. Device according to claim 1, characterised in that the high-frequency deflector (7) comprises a homogeneous transversely directed alternating field (20).

7. Device according to claim 1, characterised in that the d.c. voltage deflector (8) comprises a non-homogeneous temporally constant transverse electrical field (19).

8. Device according to claim 1, characterised in that the output coupler (11) comprises a resonator (15) in its output circuit.

9. Device according to claim 8, characterised in that the output circuit (21) comprises a single-column annular cavity (22) as resonator (15).

10. Device for electron beam pulse formation and amplification comprising (a) an electron gun (6), (b) a high-frequency deflector (7), (c) a d.c. voltage deflector (8), (d) a collector (9) having an opposing field, (e) an output coupler (11) for coupling the power of the electron beam (14) to a consumer (12), and (f) a main collector (13) for taking up the residual power of the electron beam (14), components (a) to (g) of the device being arranged behind one another in the direction of the electron beam (14).

11. Device according to claim 10, characterised in that the consumer (12) is an antenna (23) of a coaxial cable end (24), which projects into a resonator (15) that is coupled to the electron beam (14) by way of an annular gap (25) surrounding the electron beam (14).

12. Device according to claim 10, characterised in that the consumer (12) is an antenna coupler of a waveguide, the antenna coupler projecting into a resonator (15) that surrounds the electron beam (14) by means of an annular gap (25).

13. Device according to claim 10, characterised in that the consumer (12) is a coupling window to a waveguide, the coupling window opening to a resonator (15) that surrounds the electron beam (14) by means of an annular gap (25).

14. Device according to claim 10, characterised in that the electron beam gun (6) is a Pierce-type electron beam gun.

15. Device according to claim 10, characterised in that the high-frequency deflector (7) comprises a homogeneous transversely directed alternating field (20).

16. Device according to claim 10, characterised in that the d.c. voltage deflector (8) comprises a non-homogeneous temporally constant transverse electrical field (19).

17. Device according to claim 10, characterised in that the output coupler (11) comprises a resonator (15) in its output circuit (21).

18. Device according to claim 17, characterised in that the output circuit (21) comprises a single-column annular cavity (26) as resonator (15).

19. Method for ion beam acceleration carried out using a device that comprises an ion accelerator tank (1) having a central container axis (2) for guiding and accelerating a pulsed ion beam (14) in the container axis (2) and an electron beam pulse formation and amplification device (4) having an electron beam axis (5) for microstructuring and amplifying current pulses to supply the device for ion beam acceleration with high-frequency power, wherein the electron beam pulse formation and amplification device (4) is arranged with its electron beam axis (5) transverse and offset relative to the container axis (2) and produces an electron beam (14) by means of an electron gun (6) outside the ion accelerator tank (1), and by means of a high-frequency deflector (7) and a d.c. voltage deflector (8) over 50% of the electron beam current is deflected, at frequencies of from 100 MHz to 400 MHz, at regular intervals into a collector (9) having an opposing field in order to microstructure the electron beam (14), and a post-deflection accelerator (10), at an accelerator voltage of several 100 kilovolts, preferably from 200 to 400 kilovolts, guides the electron beam (14) into the ion accelerator tank (1), and accelerates the ion beam (3) by way of an output coupler (11).

20. Method according to claim 19, characterised in that the electron beam (14) is subjected to intensity modulation that corresponds to the operating frequency (f) of the ion beam (3).

21. Method according to claim 19, characterised in that the collector (9) having an opposing field takes up to 80% of the electron beam energy.

22. Method for electron beam pulse formation and amplification that comprises the following method steps:

production of an electron beam (14) by means of an electron beam gun (5), action upon the electron beam (14) of a high-frequency alternating field (20) with simultaneous high-frequency deflection of the electron beam (14), high-frequency extraction of up to 80% of the electron beam energy to a collector (9) having an opposing field, post-deflection acceleration of the high-frequency-modulated electron beam (14) to give electron beam pulses, decoupling of the high-frequency energy by way of an output coupler (11).

23. Method according to claim 22, characterised in that the decoupling of the high-frequency energy is effected by way of a coaxial cable end (24) that projects, by way of an antenna (23), into an annular resonator chamber (27) that communicates with the high-frequency energy-rich electron beam (14) by way of an annular gap (25) surrounding the electron beam (14).

24. Method according to claim 22, characterised in that the decoupling of the high-frequency energy is achieved by way of a waveguide which projects, by means of a coupling antenna, into an annular resonator chamber (27) that communicates with the high-frequency energy-rich electron beam (14) by way of an annular gap (25) surrounding the electron beam (14).

25. Method according to claim 22, characterised in that the decoupling of the high-frequency energy is effected by way of a waveguide connected to an annular resonator (27) by way of a coupling window, the resonator (15) communicating with the electron beam (14) by way of an annular gap (25) surrounding the electron beam (14).

26. Method according to claim 22, characterised in that an electron beam (14) having high perveance according to the Child-Langmuir equation is produced by an electron beam gun (6) with an electron beam of from 20 A to 60 A, preferably from 30 A to 50 A, at an acceleration voltage ($U_c$) of from 20 kV to 60 kV, preferably from 30 kV to 50 kV.

27. Method according to claim 22, characterised in that the electron beam (14) is stabilised transversely in Brillouin equilibrium by means of a longitudinal magnetic field.

28. Method according to claim 22, characterised in that the intensity-modulated electron beam (14) excites a narrow-band HF resonator in the output circuit at an operating frequency (f).

29. Method according to claim 22, characterised in that the electron beam (14) passes through a homogeneous transversely directed electrical alternating field (20).

30. Method according to claim 22, characterised in that from 50% to 80% of the electron beam energy is deflected from the electron beam axis (5).

31. Method according to claim 22, characterised in that, at virtually constant electron energy of from 30 keV to 50 keV, the deflected portion of the electron beam is collected in a biased collector (9) having an opposing field of from −30 kV to −40 kV.

32. Method according to claim 22, characterised in that the energy of collected electrons is collected in a collector (9) having an opposing field and is fed as a charging current to the cathode of the electron beam gun (6).

33. Method according to claim 22, characterised in that the undeflected electron packages move along the electron beam axis (14) at the temporal spacing of an operating frequency (f) and enter an output circuit (21) of the device, which output circuit is in the form of a resonator (15), at a main acceleration voltage of from 200 to 400 kV.

34. Method according to claim 22, characterised in that a resonator (15) in the output circuit (21) of the device starts to operate, with high-frequency fields in the resonator (15) taking up the energy of the electrons, decelerating them and feeding an output circuit, preferably a coaxial cable end (24) and/or a waveguide.

35. Method according to claim 22, characterised in that residual energy of the electrons is deposited in a main collector (13).

36. Method according to claim 22, characterised in that for electronic deflection in the high-frequency deflector (7) for an operating frequency (f) the actuated high-frequency signal consists of a main component at frequency (f/2) and superposition of frequency (5f/2) at an amplitude ratio of 5:1.

37. Device for high-frequency power amplification, especially for supplying a device having a cavity for ion beam acceleration with high-frequency power, comprising:

a vacuum tank having a central tank axis for producing and accelerating a pulsed electron beam (14) along the tank axis, characterised in that an electron beam pulse formation and amplification device (4) is arranged with its electron beam axis (5) transverse and offset relative to a container axis (2) of an ion accelerator tank (1) and comprises outside the ion accelerator tank (1)

(a) an electron gun (6), (b) a high-frequency deflector (7), (c) a d.c. voltage deflector (8), (d) a collector (9) having an opposing field, and (e) a post-deflection accelerator (10), and comprises inside the ion accelerator tank (f) a first gap and a second gap for coupling the power of the electron beam (14) to the ion beam (3), (g) a main collector (13) for taking up the residual power of the electron beam (14), components (a) to (g) of the device being arranged behind one another in the direction of the electron beam (14).

38. Device according to claim 37, characterised in that an output circuit comprises an output coupler to feed into a waveguide.

39. Device according to claim 38, characterised in that the output circuit is in the form of a single-column cavity.

40. Device according to claim 38, characterised in that all of the electron beam energy can be produced in the electron beam gun without post-deflection acceleration.

* * * * *